United States Patent [19]

Little

[11] Patent Number: 4,587,945

[45] Date of Patent: May 13, 1986

[54] ARROW SUPPORT, SIGHT AND GUIDE

[76] Inventor: Darlan R. Little, 4451 Comanche Dr., Okemos, Mich. 48864

[21] Appl. No.: 551,196

[22] Filed: Nov. 14, 1983

[51] Int. Cl.[4] ..... F41B 5/00

[52] U.S. Cl. ..... 124/87; 124/88

[58] Field of Search ..... 124/87, 23 R, 24 R; 33/265

[56] References Cited

U.S. PATENT DOCUMENTS

| | | | |
|---|---|---|---|
| 2,814,284 | 11/1957 | Sileo | 124/87 X |
| 2,909,167 | 10/1959 | Fredrickson | 124/24 R |
| 3,406,675 | 10/1968 | Fredrickson | 124/24 R |
| 4,170,071 | 10/1979 | Mann et al. | 124/87 X |
| 4,282,850 | 8/1981 | Warnicke | 124/24 R |
| 4,291,664 | 9/1981 | Nishioka | 124/87 X |

*Primary Examiner*—Richard J. Apley
*Assistant Examiner*—William R. Browne
*Attorney, Agent, or Firm*—Malcolm R. McKinnon

[57] ABSTRACT

An arrow support, sight and guide for supporting, aiming and guiding arrows from an archery bow and enabling rapid shooting of arrows of various shaft diameters with increased accuracy, the arrow support, sight and guide including a body defining an internal passageway that is open at each end. A plurality of angularly spaced ribs carried by the body project into the passageway and terminate at substantially flat support surfaces which extend longitudinally of the passageway and which are adapted to engage tangentially the periphery of a cylindrical shaft of an arrow. In one embodiment of the invention, one of the support surfaces is adjustable relative to the longitudinal axis of the passageway while in other embodiments of the invention, all of the support surfaces are fixed. A plurality of sighting pins are carried by the body, the sighting pins being adjustable for applicable range distances and windage.

4 Claims, 6 Drawing Figures

FIG. 2.
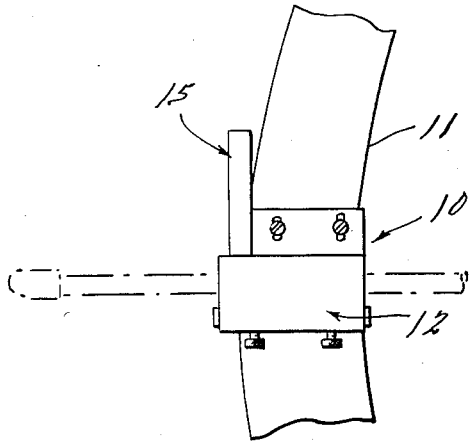
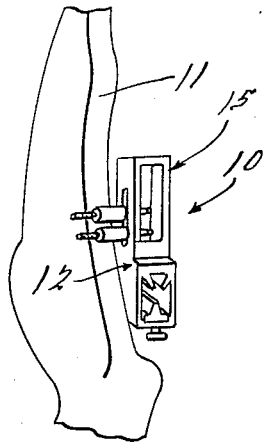
FIG. 1.
FIG. 4.
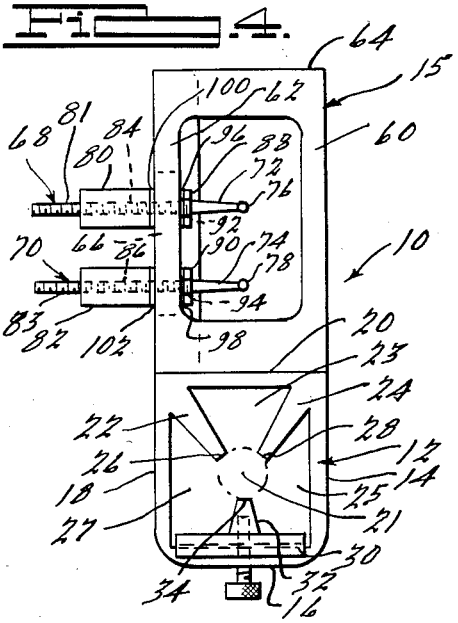
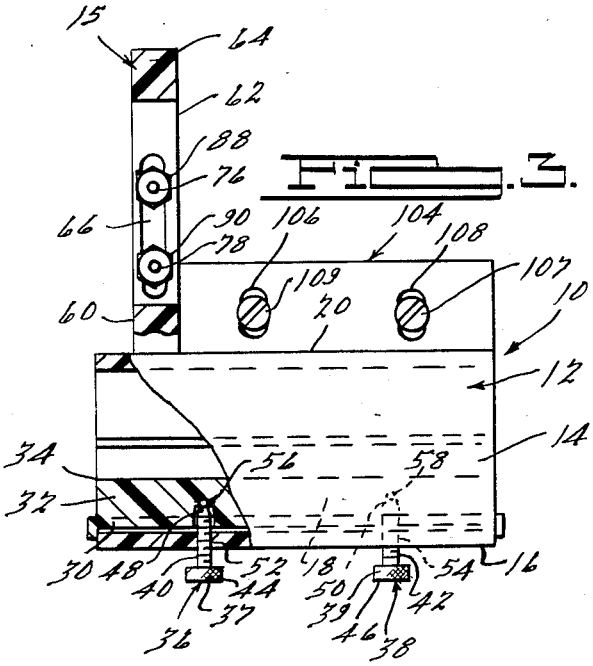
FIG. 3.
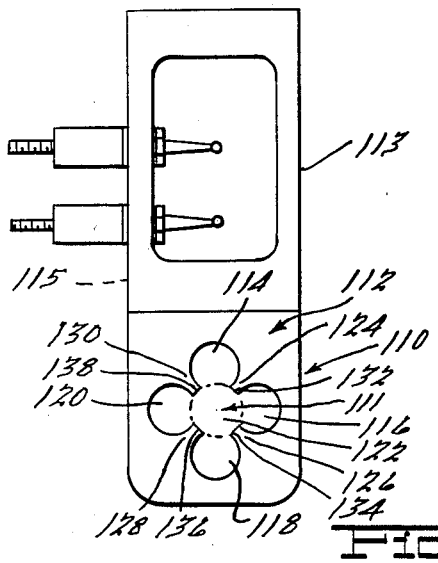
FIG. 5.
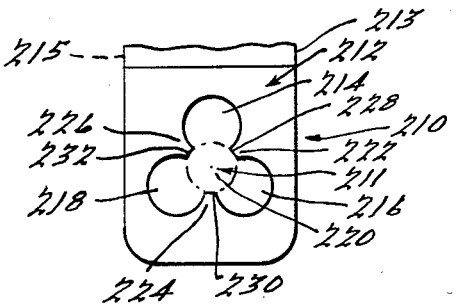
FIG. 6.

ARROW SUPPORT, SIGHT AND GUIDE

BRIEF SUMMARY OF THE INVENTION

This invention relates to supporting, sighting and guiding devices for archery arrows and, more particularly, to an improved arrow support, sight and guide incorporating improved means for supporting, aiming and guiding arrows from an archery bow and enabling the rapid shooting of arrows of various shaft diameters with increased accuracy.

Heretofore many types of devices have been provided for supporting, sighting and/or guiding arrows from an archery bow. An object of the present invention is to overcome disadvantages in prior supporting, sighting and/or guiding devices of the indicated character and to provide an improved unitary arrow support, sight and guide incorporating, in a single device, improved means for supporting, aiming and guiding arrows of various shaft diameters whereby such arrows may be rapidly shot from an archery bow with increased accuracy.

Another object of the present invention is to provide an improved arrow support, sight and guide incorporating improved means for holding an arrow in a stable position, ready for shooting, whereby the arrow may be aimed and rapidly shot from an archery bow with increased accuracy.

Another object of the present invention is to provide an improved arrow support, sight and guide which may be easily and quickly mounted on a wide variety of archery bows with a minimum expenditure of time, labor and expense.

Another object of the present invention is to provide an improved arrow support, sight and guide which obviates the need for separate arrow rests, arrow holders and other arrow support, sighting and/or guiding devices.

Another object of the present invention is to provide an improved unitary, combined arrow support, sight and guide which may be mounted on an archery bow in the manner of a conventional arrow rest.

Another object of the present invention is to provide an improved arrow support, sight and guide which eliminates the need for holding an arrow on an archery bow with the arrow nock on the bow string.

Another object of the present invention is to provide an improved arrow support, sight and guide which increases the accuracy and reduces the time required to aim and shoot an arrow from an archery bow.

Another object of the present invention is to provide an improved arrow support, sight and guide which may be easily and quickly adjusted to accommodate arrows of varying nominal diameters.

Still another object of the present invention is to provide an improved arrow support, sight and guide which incorporates multiple channels correlated with the number of fletching segments affixed to the arrow whereby the multiple channels provide a pathway for the individual arrow fletchings to pass therethrough substantially unimpeded by contact with any element of the arrow support, sight and guide as the arrow is released from the fully nocked position toward its intended target.

The above as well as other object and advantages of the present invention will become apparent from the following description, the appended claims and the accompanying drawings.

BRIEF DESCRIPTION OF THE DRAWINGS

FIG. 1 is a perspective view of an arrow support, sight and guide embodying the present invention, showing the same installed on an archery bow;

FIG. 2 is an enlarged, side elevational view of the arrow support, sight and guide illustrated in FIG. 1, taken from the right of FIG. 1;

FIG. 3 is an enlarged, fragmentary, side elevational view, with portions broken away, of the arrow support, sight and guide illustrated in FIG. 2;

FIG. 4 is an end view of the arrow support, sight and guide illustrated in FIG. 3;

FIG. 5 is an end elevational view of another embodiment of the invention; and FIG. 6 is an end elevational view of still another embodiment of the invention.

DETAILED DESCRIPTION

Referring to the drawings, a preferred embodiment of the invention is illustrated in FIGS. 1 through 4 thereof, and is comprised of an arrow support, sight and guide, generally designated 10, that is adapted to be mounted on a conventional archery bow 11. The arrow support, sight and guide 10 includes a generally rectangularly boxed shaped body portion, generally designated 12, and an integral sight portion, generally designated 15, the body portion 12 and the sight portion 15 preferably being formed of hard plastic or other suitable materials having sufficient strength to withstand the forces exerted thereon. The body portion 12 is comprised of four generally rectangular walls 14, 16, 18 and 20 which define an internal passageway that extends through the body portion 12 and is open at each end, the internal passageway having a theoretical longitudinal axis 21 extending through the center of the body portion 12. A pair of longitudinally extending ribs 22 and 24 are provided which are formed integrally with the body portion 12 and which project into the passageway defined by the body portion toward the theoretical longitudinal axis 21 of the body portion 12. The ribs 22 and 24 are of generally trapezium configuration, in transverse cross section, the rib 22 originating at the internal junction of the body walls 18 and 20 and extending longitudinally throughout the entire length of the internal passageway defined by the body 12. The radially inner end portion of the rib 22 terminates in a substantially flat surface 26. The rib 24 is oppositely angularly inclined with respect to the rib 22, the rib 24 originating at the internal junction of the body walls 14 and 20. The rib 24 also extends longitudinally throughout the entire length of the passageway defined by the body 12, and the rib 24 terminates in a substantially flat surface 28. The surfaces 26 and 28 of the ribs 22 and 24, respectively, are preferably disposed at substantially equal distances from the theoretical axis 21, such distances being approximately equal to the nominal radius of the shaft of an arrow. It should also be understood that, if desired, the ribs 22 and 24 may be longitudinally interrupted, that is, segmented along the length thereof.

A generally rectangularly shaped adjustable support plate 30 is provided which is adapted to be disposed in the passageway defined by the body portion 12 and in proximity to the inner surface of the body wall 16. Formed integrally with the adjustable support plate 30 is a rib 32 which is of generally trapezoidal configuration, in transverse cross section, the rib 32 extending for substantially the entire length of the body portion 12 intermediate the longitudinal edges of the support plate 30. When viewed in transverse cross section, the rib 32 is disposed such that its base is adjacent the inner surface of the adjustable support plate 30, and the rib 32 terminates in a substantially flat edge 34. With such a construction, a channel 23 is defined between the ribs 22 and 24 and the body wall 20, while a channel 25 is defined between the ribs 24 and 32, the body wall 14 and the adjustable support plate 30. A channel 27 is also defined between the ribs 22 and 32, the body wall 18, and the adjustable support plate 30. When viewed in transverse cross section, the flat surfaces 26, 28 and 34 are disposed in generally confronting relationship and are each adapted to make substantially line contact with the periphery of an arrow shaft, the lines of contact being angularly spaced at angles of approximately 120 degrees. The line contact provided by the flat surfaces 26, 28 and 34 of the ribs provides a stable support for an arrow after it has been inserted into the body portion 12, and such line contact provides a minimum of frictional resistance as such flat surfaces guide an arrow through the body portion 12 when the arrow is shot by the bow 11.

Means is provided for adjustably moving the support plate 30 along the vertical axis of the body portion 12. Such means is comprised of a pair of adjustable screws, generally designated 36 and 38, having threaded shank portions 40 and 42, respectively, head portions 44 and 46 provided with serrated or knurled edges 37 and 39, respectively, and generally ball shaped tips 48 and 50, respectively. The adjustment screws 36 and 38 are threadedly engaged with tapped holes 52 and 54, respectively, provided in the body wall 16 intermediate the longitudinal edges thereof and substantially equidistant from each other and the lateral edge portions of the body wall 16. Sockets 56 and 58 are provided in the adjustable support plate 30 on the side thereof adjacent to body wall 16, the sockets 56 and 58 being aligned with the tapped holes 52 and 54, respectively, and being adapted to receive the generally ball shaped tips of the screws 36 and 38, respectively, with a snap fit. With such a construction, the manual application of torque to the serrated or knurled surfaces 37 and 39 of the adjustable screw heads 44 and 46, respectively, results in the vertical movement of the support plate 30, rotation of the screws 36 and 38 in one direction causing the support plate to move toward the axis 21 of the body portion 12 while rotation of the screws 36 and 38 in the opposite direction causes the support plate 30 to move toward the inner surface of the wall 16 of the body portion 12. Such movement of the adjustable plate 30 varies the diameter of the imaginary cylinder partially tangentially defined by the flat surfaces 26, 28 and 34 of the ribs 22, 24 and 32, respectively, thereby permitting the user to adjust the device to accommodate arrows of varying nominal shaft diameters.

Since three channels 23, 25 and 27 are defined by this embodiment of the invention, it is intended that arrows having three fletches or feathers be utilized with this embodiment of the invention. As an arrow is released from the fully nocked position, each of the fletches or feathers passes through one of the three channels substantially unimpeded by contact with the body portion 12. Moreover, since the flat surfaces 26, 28 and 34 only make line contact with the periphery of the shaft of the arrow, increased accuracy is obtained with a minimum of frictional resistance.

The sighting or aiming portion of the arrow support, sight and guide 10 is preferably formed integrally with the body portion 12 and is comprised of vertically disposed wall portions 60 and 62 which project upwardly from the body portion 12 and which are joined by a horizontally extending top wall 64. The wall 62 defines a vertical slot 66 adapted to receive a plurality of elongated sight pins 68 and 70 which are adjustably mounted in the slot 66 and which project horizontally into the internal passageway defined by the walls of the sight portion 15. The sight pins 68 and 70 are substantially identical in construction, and have tapered portions 72 and 74, respectively, terminating in beads 76 and 78, respectively. The beads are preferably color coded so that each bead has a different color than the bead on the other sighting pin. With such a construction, the user is enabled to differentiate between the beads which can be set for different target distances and windage variations. The sight pins also include threaded shank portions 81 and 83, respectively, and nut members 80 and 82 having internally threaded bores 84 and 86, respectively, are provided together with nut members 88 and 90, having internally threaded bores 92 and 94, respectively. The sight pins 68 and 70 are adjustably mounted in the slot 66 by the nut members which threadably engage the shank portions of the sight pins and bear against the opposite sides of the wall 62. If desired, lock washers such as 96, 98, 100 and 102 may be provided to retain the nuts in the selected adjusted position.

In use, the vertical and horizontal positions of the sighting beads 76 and 78 may be adjusted in accordance with the applicable range distances and windage. For example, the upper sighting bead 76 may be set for a range of 50 yards while the lower sighting bead 78 is set for a range of 100 yards. Adjustments for windage conditions may thus be made by rotating the sight pins to move the sight beads horizontally while adjustments for distance may be accomplished by moving the sight beads vertically. When the sight pins have been located in their desired vertical and horizontal positions, the nut members 80 and 82 are tightened by finger pressure against the lock washers 100 and 102, respectively, while the nut members 88 and 90 are similarly tightened against their corresponding lock washers 96 and 98, respectively, thereby securing the pin members 68 and 70 firmly to the wall 62.

The arrow support, sight and guide 10 is adapted to be mounted on an archery bow 11 through the agency of a retaining plate 104 which is formed integrally with the body portion 12 and which defines a pair of vertically disposed, elongated slots 106 and 108. The retaining plate 104 is preferably an integral vertical extension of the body wall 18. Attachment of the arrow support, sight and guide 10 to the archery bow 11 is effected by drilling holes in the bow 11 at locations corresponding to the elongated slots 106 and 108. The body wall 18 is then placed adjacent to the bow 11, and screws 107 and 109 having head portions larger than the width of the elongated slots 106 and 108, are inserted through the elongated slots and threaded into the bow 11. Adjustments of the arrow support, sight and guide 10 may be made relative to the bow 11 before the screws 107 and 109 are tightened. After the desired location has been found, the screws may be tightened so as to securely fix the arrow support, sight and guide 10 to the bow 11.

In operation, an arrow is inserted into the passageway defined by the body portion 12 and held in position by the surfaces 26, 28 and 34. The arrow may also be placed in the nocked position, and may be sighted or aimed by aligning the desired sighting bead with the target. When the arrow is released from the fully drawn position, the arrow is guided by the surfaces 26, 28 and 34 as it travels through the body portion 12 while the fletches or feathers of the arrow pass through the channels 23, 25 and 27 substantially unimpeded by contact with the body portion 12. The arros is thus supported and guided through the arrow support, sight and guide 10 with greater efficiency and accuracy than that provided by prior devices.

Another embodiment of the invention is illustrated in FIG. 5 and is intended for use with arrows having four fletching elements or feathers. This embodiment of the invention is comprised of an arrow support, sight and guide, generally designated 110, that includes a generally rectangularly box shaped body portion 112 defining a longitudinally extending passageway, generally designated 111. This embodiment of the invention also includes an attachment plate 115, and a sight portion, generally designated 113, which is constructed in the same manner as the sight portion 15 previously described. The passageway 11 is comprised of four generally cylindrical bores 114, 116, 118 and 120 disposed around and slightly overlapping a central cylindrical bore 122. The longitudinal axes of the bores 114, 116, 118 and 120 are disposed in substantially parallel relationship with respect to each other and with respect to the axis of the passageway 111, the axes of the bores 114, 116, 118 and 120 also being disposed at substantially equal distances from the axis of the passageway 111 and in equally angularly spaced relationship with respect to each other.

In this embodiment of the invention, the body portion 112 includes a rib 124 which is disposed between the bores 114 and 116, and a rib 126 which is disposed between the bores 116 and 118. The body portion also includes a rib 128 which is disposed between the bores 118 and 120, and a rib 130 which is disposed between the bores 120 and 114. When viewed in transverse cross section, the longitudinally extending ribs 124, 126, 128 and 130 are disposed in substantially equally angularly spaced relationship, andl the ribs terminate in substantially flat longitudinally extending surfaces 132, 134, 136 and 138. The perimeter of the bore 122 is thus partially tangentially defined by the substantially flat longitudinally extending surfaces 132, 134, 136 and 138 which serve to guide and support the shafts of the arrows as they make line contact therewith. In this embodiment of the invention, the surfaces 132, 134, 136 and 138 are disposed in fixed positions and spaced apart a distance such as to accommodate nominal shaft diameters.

In use, an arrow may be inserted through the bore 122 defined by the surfaces 132, 134, 136 and 138 so as to be supported and guided by such surfaces. The arrow may then be sighted or aimed by aligning one of the sight pins, constructed in the manner previously described, with the target. Once released from the fully drawn position, the arrow travels longitudinally through the central bore 122 guided and supported by the line contact with the surfaces 132, 134, 136 and 138, while the fletches or feathers pass through the bores 114, 116, 118 and 120 substantially unimpeded by contact with the body portion 112. As a result, the arrow is guided through the arrow support, sight and guide 110 with greater efficiency than that provided by prior devices, and the arrow travels toward its intended target with greater accuracy than could be achieved with the use of prior devices.

As previously mentioned, the sight means 113 and attachment plate 115 are preferably integrally formed with the body portion 112 and are substantially identical to the sight means and attachment plate 104 illustrated in FIGS. 1 through 4.

Another embodiment of the invention is illustrated in FIG. 6 and is intended for use with arrows having three fletches or feathers. This embodiment of the invention is comprised of an arrow support, sight and guide, generally designated 210, that includes a generally rectangularly box shaped body portion 212 which defines a longitudinally extending passageway 211 that is open at each end. An attachment plate 215 and a sight means, generally designated 213, are also provided which are formed integrally with the body portion 212 and which are constructed in substantially the same manner as the sight means and attachment plate illustrated in FIGS. 1 through 4.

The passageway 211 is comprised of three generally cylindrically shaped bores 214, 216 and 218 which are disposed around and slightly overlap a centrally located cylindrical bore 220. The longitudinal axes of the bores 214, 216 and 218 are disposed in substantially equally angularly spaced relationship and at substantially equal distances from and parallel to the axis of the bore 220. In this embodiment of the invention, the body portion 212 is provided with a rib 222 which is disposed between the bores 214 and 216, and a rib 224 which is disposed between the bores 216 and 218. The body portion 212 also includes a rib 226 which is disposed between the bores 218 and 214. The ribs 222, 224 and 226 terminate in longitudinally extending substantially flat surfaces 228, 230 and 232, respectively, which partially tangentially define the perimeter of the bore 220 which is adapted to accommodate arrows having the desired nominal shaft diameter.

In operation, an arrow may be inserted through the body portion 212 and supported in place by line contact with the surfaces 228, 230 and 232. The arrow may then be sighted or aimed in the manner previously described utilizing the sight pins previously described. When the arrow is released from the fully drawn position, the arrow shaft travels longitudinally through the central bore 220 while the three fletching elements pass through the bores 214, 216 and 218 substantially unimpeded by contact with the body portion 212. As a result, the arrow is guided through the body portion 212 more efficiently and with greater accuracy than could be achieved with the use of prior devices.

While preferred embodiments of the invention have been illustrated and described, it will be understood that various changes and modifications may be made without departing from the spirit of the invention. For example, other embodiments of the invention may be constructed for mounting on the side of the bow opposite that shown in the drawings.

What is claimed is:

1. In an arrow support, sight and guide, the combination including a body defining a passageway open at each end and having a longitudinal axis, a plurality of substantially equally angularly spaced ribs carried by said body and projecting into said passageway, said ribs terminating at substantially flat support surfaces extending longitudinally of said passageway, said support surfaces being substantially equally radially spaced from the longitudinal axis of said passageway and being adapted to engage tangentially and with line contact only the periphery of a cylindrical shaft of an arrow, each of said support surfaces having a length substantially greater than the maximum outside diameter of a shaft of an arrow to be supported thereby, and sighting means carried by said body, said sighting means including a sighting pin disposed in a vertical plane normal to the longitudinal axis of said passageway.

2. An arrow support, sight and guide comprising, in combination, a generally rectangularly box shaped body comprised of generally rectangular walls defining an internal passageway open at each end and having a longitudinal axis, a plurality of substantially equally angularly spaced ribs carried by said body and projecting into said passageway, the inner end portion of each of said ribs having a substantially flat support surface extending longitudinally of said passageway, said support surfaces being substantially equally radially spaced from the longitudinal axis of said passageway and being adapted to engage tangentially and with line contact only the periphery of a cylindrical shaft of an arrow, each of said support surfaces having a length substantially greater than the maximum outside diameter of a shaft of an arrow to be supported thereby, sighting means carried by said body, said sighting means including a sighting pin disposed in a vertical plane normal to the longitudinal axis of said passageway, and means for securing said body to be an archery bow.

3. An arrow support and guide comprising, in combination, a body defining a passageway open at each end and having a longitudinal axis, a plurality of substantially equally angularly spaced ribs carried by said body and projecting into said passageway, said ribs terminating at substantially flat support support surfaces extending longitudinally of said passageway, said support surfaces being substantially equally radially spaced from the longitudinal axis of said passageway and being adapted to engage tangentially and with line contact only the periphery of a cylindrical shaft of an arrow, each of said support surfaces having a length substantially greater than the maximum outside diameter of the shaft of an arrow to be supported thereby, and means for adjusting the radial position of one of said support surfaces relative to the longitudinal axis of said passageway.

4. The combination as set forth in claim 3 including means for securing said body to an archery bow.

* * * * *